US005259478A

United States Patent [19]

Berish et al.

[11] Patent Number: 5,259,478

[45] Date of Patent: Nov. 9, 1993

[54] PUMP JACK WITH RELEASE MECHANISM

[75] Inventors: Robert P. Berish, Sharon; Steven J. Ford, Avon, both of Mass.

[73] Assignee: Quality Steel Products, Inc., Stoughton, Mass.

[21] Appl. No.: 57,992

[22] Filed: May 5, 1993

[51] Int. Cl.[5] ..... A63B 27/00

[52] U.S. Cl. ..... 182/136; 248/243; 254/106

[58] Field of Search ..... 182/133–136; 254/106; 248/243–245

[56] References Cited

U.S. PATENT DOCUMENTS

| | | | |
|---|---|---|---|
| 2,216,912 | 10/1940 | Hortsma | 182/136 |
| 4,463,823 | 8/1984 | Anderson | 182/136 |
| 4,955,584 | 9/1990 | Anderson | 182/136 X |

*Primary Examiner*—Alvin C. Chin-Shue
*Attorney, Agent, or Firm*—Pandiscio & Pandiscio

[57] ABSTRACT

An improved pump jack of the type comprising a metal frame that has two parallel spaced frame members carrying upper and lower shackle assemblies arranged to grip a supporting pole, and a pump arm coupled to the frame and the upper shackle assembly for raising the jack. An improved releasing mechanism is provided comprising a U-shaped release member disposed between the two frame members. The U-shaped release member has two opposed struts each provided with an elongate hole adjacent one end to slidably and rotatably receive a pivot shaft that is anchored in the two frame members. The elongate holes in the opposite ends of the release member's side struts are aligned with holes in the forward ends of the side arms of the shackle member of the lower shackle assembly. The holes in the side arm of the lower shackle member are sized and shaped to non-rotatably accommodate the front clamping bar, with the latter acting to pivotally interconnect the U-shaped release member's side struts and the lower shackle. Associated with the release mechanism is a safety means that is designed to prevent accidental operation of the release mechanism.

17 Claims, 9 Drawing Sheets

PUMP JACK WITH RELEASE MECHANISM

BACKGROUND OF THE INVENTION

This invention relates to pump jacks used in the construction trade to erect elevated work platforms and, more particularly, to an improvement to the pump jack apparatus providing a safer means of lowering the work platform.

Scaffolding equipment is required at many stages in the construction or renovation of a building. In the construction trade, pump jack poles that are braced to a vertical surface and pump jacks placed thereon, are a well known alternative to complex scaffolding. The pump jacks support a work platform on which workmen can stand. A pump arm, actuated by the worker's foot, enables the worker to raise the platform up the poles to the required height. Disengaging a portion of the pump jack from the pole allows the workmen to lower the platform back to ground level.

Typically, at least two poles are placed in spaced apart relationship to each other and are secured by braces to the vertical side of a building. Pump jacks are then mounted on each pole. Each pump jack includes a platform support upon which the end of a wooden or metal plank is supported, thus forming a platform. The platform may be provided with an extension so as to allow it to accommodate two or more planks. A worker stands on the platform and raises the jack and the adjacent end of the platform by pumping the jack's pump arm with his foot. The pumping action raises the jack and the adjacent end of the platform in a stepwise manner up the pole. To lower the platform, the worker disengages one shackle (typically the "lower" shackle) on the jack while turning a crank actuated spiral rod that causes a second shackle (typically the "upper" shackle) to creep down the pole and thereby lower the platform.

Pump jacks are well known. For example, U.S. Pat. Nos. 1,416,296, 1,441,806, 2,038,899, and 2,216,912 all issued to P. Hoitsma and U.S. Pat. No. 4,463,828 issued to C. Anderson, teach pump jacks of the type contemplated by the instant invention.

In a typical prior art pump jack a metal frame supports a lower metal shackle assembly. The lower shackle assembly includes front and rear clamping bars that apply a coupling force for gripping the pole. A pump arm is pivotally coupled to the frame and an upper shackle assembly that is generally similar in construction to the lower shackle assembly. The upper shackle assembly includes a front clamping member in the form of a rotatable spiral rod and a rear clamping bar. The rear clamping bar of the upper shackle assembly applies a coupling force for gripping the pole. Biasing mechanisms forming part of the shackle assemblies respond to the pumping action of the pump arm to alternately position each of the shackles in gripping relationship with the pole. The pump arm operates in a downward stroke to pivotally drive the frame stepwise upwardly along the pole, with the upper shackle gripping the pole and providing the upward moving force. When the pump arm is moved upwardly by the operator's foot, the upper shackle moves upwardly along the pole while the lower shackle grips the pole and the frame remains stationary. A single workman can lift the platform up the poles to the required height by alternately pumping the pump arms of each pump jack. Alternatively, two workmen can work in unison to pump the platform up the poles. Lowering the platform can be achieved by a single workman operating each jack in alternating fashion, or by two workmen operating the two jacks in unison with one another.

In order to bring the pump jack down the pole, the lower shackle must be released from gripping relationship with the pole. Typically, the lower shackle is moved by the operator so that its front clamping bar is no longer gripping the surface of the pole. A crank arm on the end of the spiral rod, allows the workman to crank the pump jack down the pole while the lower shackle is disengaged (released) from the pole.

In pump jacks preceding the Anderson invention, releasing of the lower shackles to permit platform lowering was accomplished by having the workman or operator extend one of his feet out and around the pole toward the front of the pump jack into engagement with the front clamping bar of the lower shackle. That foot then was used to force the shackle in a direction to cause its front clamping bar to release the pole. Such pump jacks can be lowered only while the front clamping bar of the lower shackle is displaced by the pressure of the worker's foot far enough to release its grip on the pole. If the worker's foot misses the end of the clamping bar or slips off, the worker can lose his balance and fall off the platform. This situation creates a major safety hazard, especially when the platform is raised to heights in excess of 20–30 feet above the ground. Worker's safety regulations in the U.S., Canada, and Europe have mandated scaffolding that does not require the worker to extend any part of his body beyond the platform in order to maneuver the scaffolding.

In the patent to Anderson mentioned above, a pedal-type release mechanism has been incorporated into the pump jack to release the lower shackle. The pedal-type release mechanism is disposed on one side of the frame and comprises a leg having one end coupled to the lower shackle. This leg is slidably retained by a clamp located on the outside of the frame. The release mechanism includes a foot-engaging pedal that is angled toward the adjacent frame member so as to bias a workmen's foot toward the frame of the pump jack.

Unfortunately, Anderson's invention suffers from several disadvantages. First, his design still requires an operator to extend his foot over one edge of the platform. Second, the release mechanism applies force to only one end of the front clamping bar of the lower shackle. This configuration applies a torsional force to the lower shackle that conceivably could impede satisfactory operation of the release mechanism and the desired movement of the shackle, possibly even causing a jam. If such jamming should occur, the front clamping bar may need to be kicked by the worker until it disengages the pole. Kicking the front clamp bar increases the likelihood that the worker will lose his balance and fall from the platform. Essentially, Anderson's design does not allow for a safe release of the front clamping bar.

OBJECTS AND SUMMARY OF THE INVENTION

Accordingly, a primary object of the present invention is to provide a pump jack release mechanism which avoids the aforementioned problems of the prior art devices.

A further object is to provide a pump jack with improved safety, particularly when descending a pole.

A still further object of the present invention is to provide a pump jack release mechanism which is easily actuated without the operator having to extend his foot over the edge of the platform.

Yet another object is to provide a release mechanism that applies a symmetrical force to release the front clamping bar of a shackle of a jack of the type described.

Still another object is to provide a pedal-type release mechanism for a jack of the type described that provides means for preventing accidental release of the jack.

These and other objects of the present invention are achieved in a preferred embodiment of the invention by incorporating a U-shaped foot-operated release member between two opposed frame members of the jack. The U-shaped release member's pedal-type closed end extends outwardly from between the frame members and is positioned between the jack's pump arm and its platform support. Each of the two side struts of the U-shaped release member have elongate holes adjacent one end. A first pivot shaft extends through these elongate holes and slidably connects the two side struts to the two frame members. Holes in the distal (front) end of the release member's side struts align with holes in the distal end of the side arms of the lower shackle to accommodate the front clamping bar, with the latter acting to interconnect the U-shaped release member's side struts and the lower shackle. The lower shackle is pivotally coupled to a shackle support member that in turn is pivotally mounted on a second pivot shaft that is affixed to and extends between the two frame members. A torsion spring is wound around that pivot shaft and is engaged with both the lower shackle and its support member. The torsion spring acts to normally bias the lower shackle in a direction to cause its front clamp bar to grip the pole.

Associated with the release mechanism is a safety mechanism that comprises a safety cap or cover unit that is pivotally coupled to a third pivot shaft that extends between the two frame members above the lower shackle assembly. The safety cap unit extends crosswise between the two frame members and projects rearwardly from the frame. The safety cap unit overlies the pedal or closed end section of the release member. The safety cap unit includes a stop portion engageable with at least one of the two frame members and a cover or cap portion that normally overlies the upper pedal-type closed end of the release member but does not exert any downward pressure on the release member.

To release the lower shackle, the safety cap unit is raised by the operator. This is easily accomplished by the operator; all that the operator needs to do is place one of his or her feet under the safety cap unit and then lift the foot so as to cause the cap unit to pivot upwardly far enough to expose the release member. Thereafter the operator moves his or her foot into engagement with the pedal-type upper end of the release member, and then presses down on the release member so as to cause it to move downwardly and also to pivot relative to the first pivot shaft. Depressing the release member causes it to apply enough force to disengage the front clamping bar of the lower shackle from the pole. The release mechanism transmits a symmetrical force to both ends of the front clamping bar of the lower shackle through the side struts of the U-shaped release member. The symmetrically applied force disengages the front clamping bar from the pole without causing it to jam. The release mechanism allows the worker to control the clamping bar's engagement with the pole by exerting enough pressure on the release member to disengage the clamp bar, while at the same time the worker is safely positioned on the platform. There is never any need for the worker to extend any part of his lower body over the end edge of the platform. When the foot pressure is released from the release member, the lower shackle automatically moves so as to force its front clamping bar back into gripping engagement with the pole, whereby to prevent further movement of the jack relative to the pole.

BRIEF DESCRIPTION OF THE DRAWINGS

Still other objects and features of the present invention will be more fully disclosed or rendered obvious in the following detailed description of the invention, which is to be considered together with the accompanying drawings wherein like numbers refer to like parts and further wherein.

DETAILED DESCRIPTION OF THE INVENTION

Figure 1:
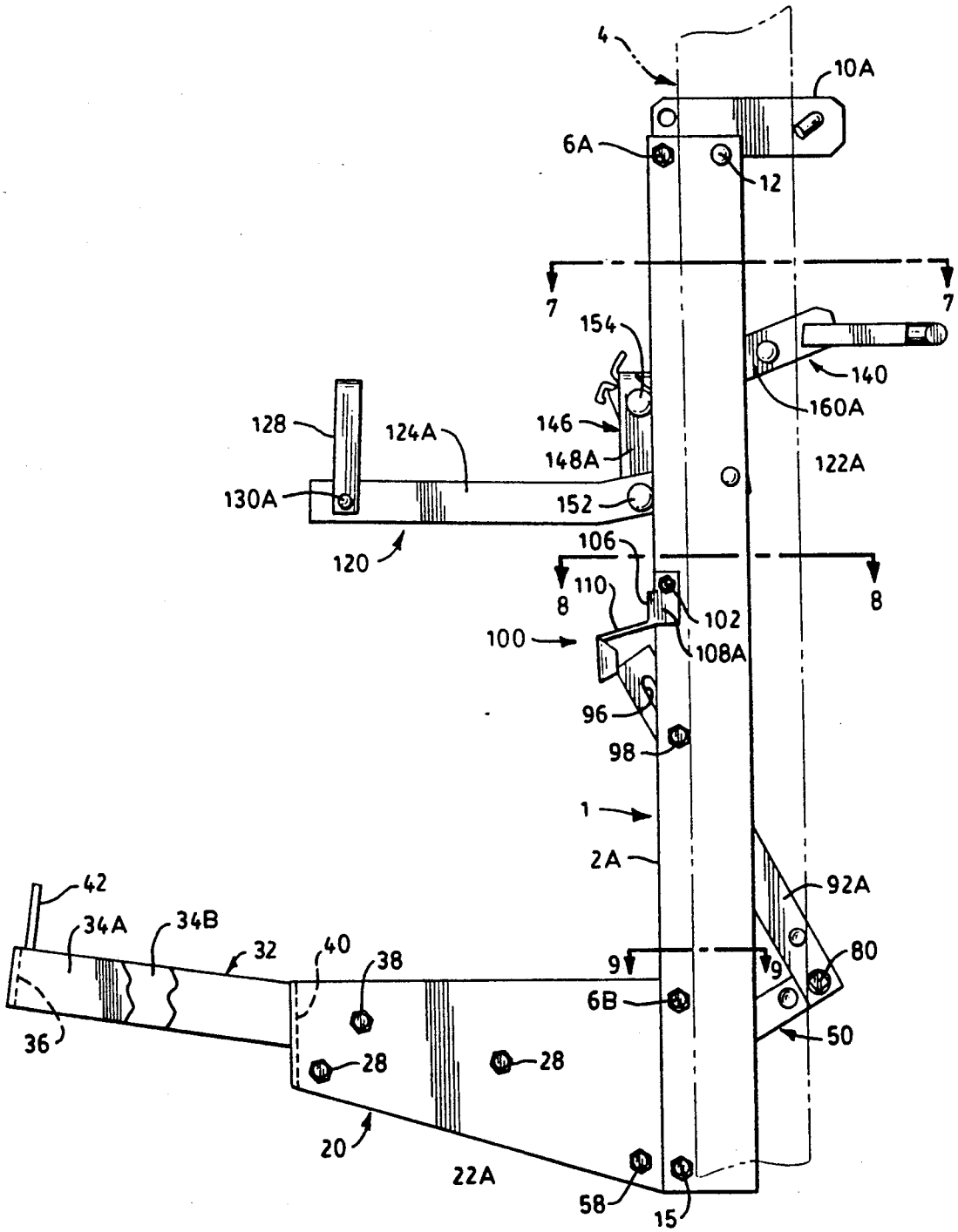
FIG. 1 is a right side elevational view of a jack incorporating the present invention showing the release mechanism in its normal at-rest position wherein the lower shackle is in gripping relation with a supporting pole.
Figure 2:
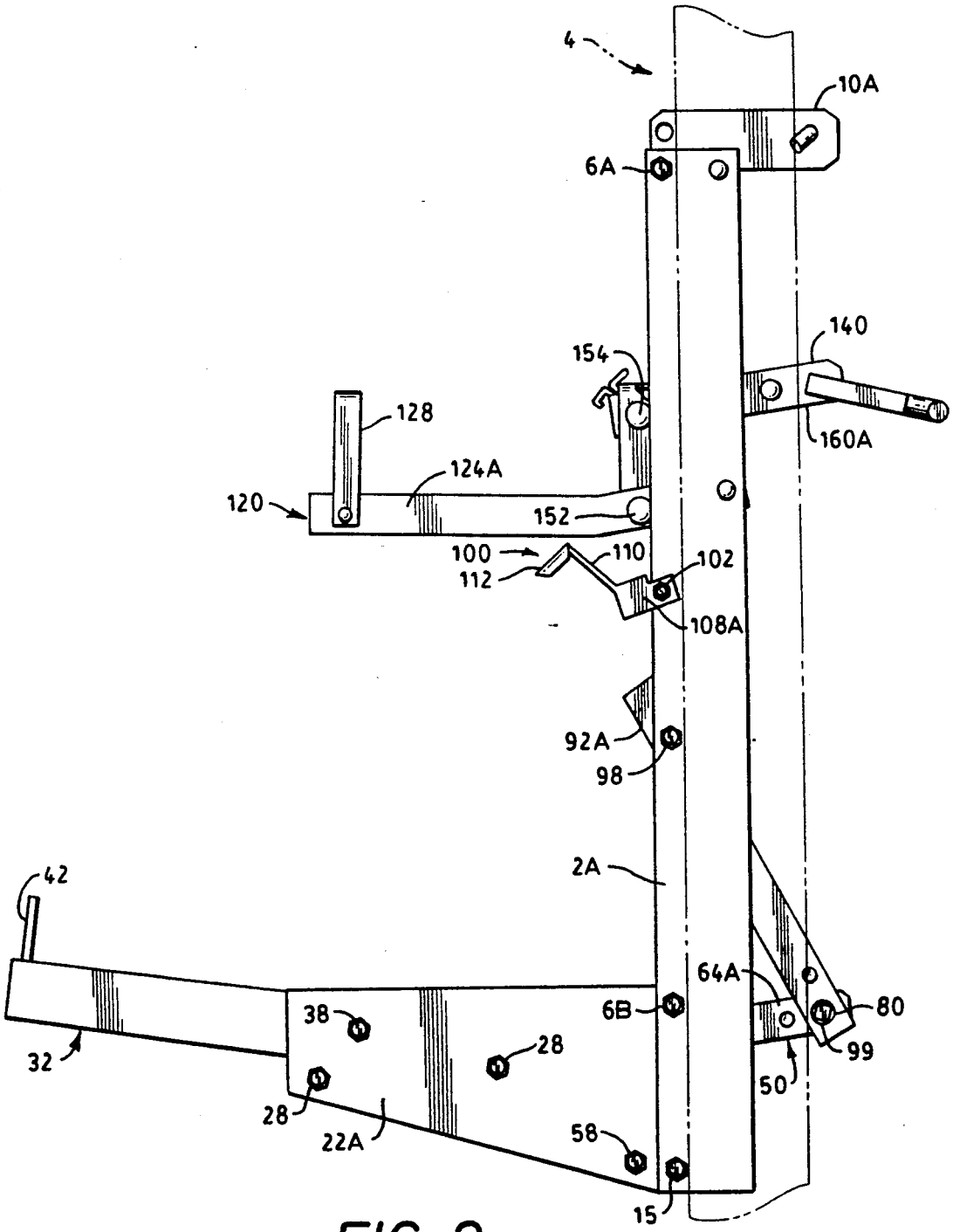
FIG. 2 is a view like FIG. 1 but with the safety cap in a partially raised position and the release mechanism shifted to a pole-releasing position.
Figure 3:
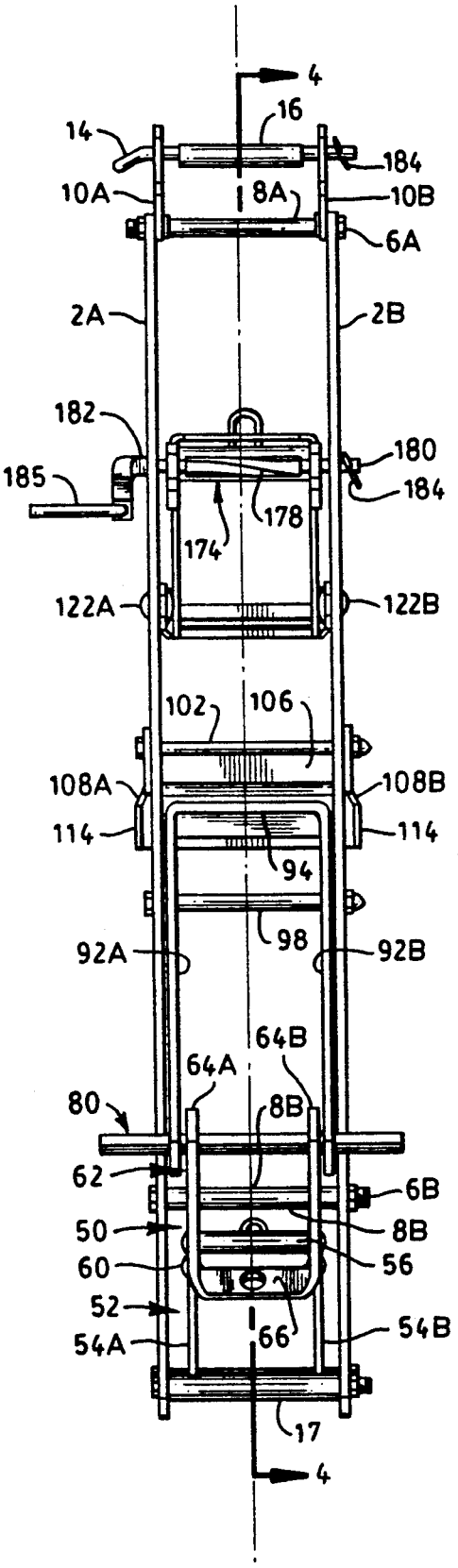
FIG. 3 is a front view in elevation of the same jack as shown in FIG. 1.

Referring to FIGS. 1-3, a pump jack is formed of a frame 1 comprising frame members 2A, 2B that are spaced apart to straddle a pole 4 (shown in phantom). The pole may be made of wood or metal, e.g., aluminum, and has a rectangular cross-section. The two frame members are secured in parallel spaced relation to one another, preferably by a plurality of tie bolts 6A, 6B that extend through the frame members and spacer sleeves 8A, 8B that surround bolts 6A, 6B and engage the inner confronting surfaces of the frame members. The upper tie bolt 6A and its spacer sleeve 8A act as a top rear pole guide for the jack.

Affixed to the upper end of the frame members 2A, 2B are upper brackets 10A, 10B. These brackets may be welded to the frame members and/or may be secured thereto by rivets as shown at 12. Extending between the forward ends of the upper brackets 10A, 10B is a round rod 14 (FIG. 3) having a sleeve 16 loosely mounted thereon so as to permit it to rotate relative to the rod. Rod 14 and sleeve 16 form a top front pole support for the pump jack during operation. A second round rod 15 is affixed to and extends between the lower ends of frame members 2A, 2B. A sleeve 17 is loosely mounted on rod 15. Sleeve 17 and rod 15 act as a bottom rear pole support for the pump jack.

Figure 4:
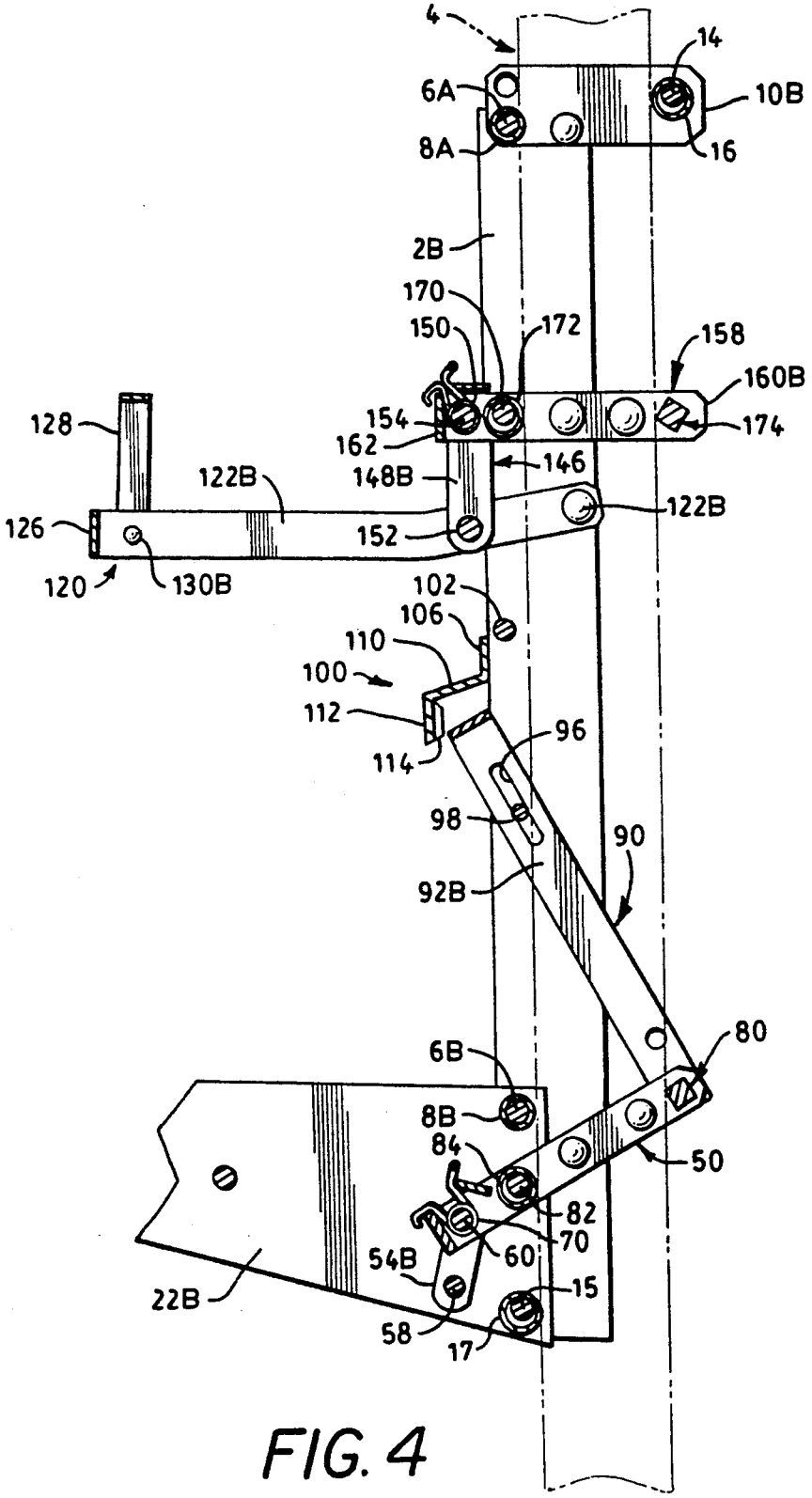
FIG. 4 is a longitudinal (vertical) sectional view taken along line 4—4 of FIG. 3 showing the lower shackle in its normal pole-gripping position.

At the lower end of the pump jack there is provided a platform support 20 comprising an opposing pair of lower brackets 22A, 22B (FIGS. 1 and 4) which are welded or bolted to frame members 2A, 2B. Additional tie bolts 28, with spacers as shown at 30 (FIG. 6) mounted thereon, help secure the lower brackets 22A, 22B so as to assure that platform support 20 forms a rigid structure. A folding rearwardly extending extension arm 32 is provided in the form of a pair of parallel side struts 34A, 34B and a connecting end strut 36. Side struts 34A, 34B are pivotally attached to side brackets 22A, 22B, respectively, by means of a pivot shaft 38. A slotted plate 40 extends between and is affixed to the rear ends of brackets 22A, 22B (FIG. 1) so as to form a limit stop to limit unfolding movement of the extension arm 32. Extension arm 32 can be pivoted upwardly clockwise (as viewed in FIG. 1) out of the way for storage. An upstanding plate 42 affixed to the end strut 36 acts as a retainer for planks positioned on extension arm 32 when the latter is in the unfolded use position shown in FIG. 1.

Figure 9:
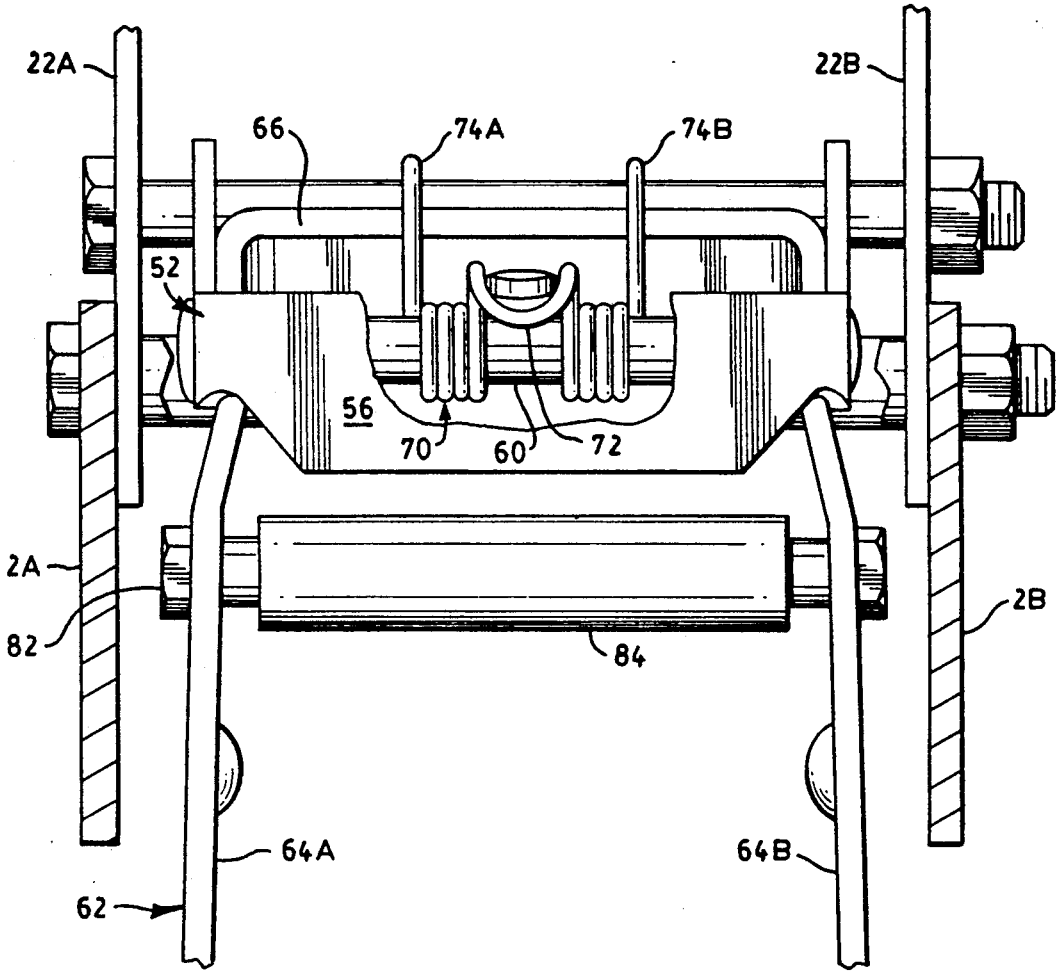

Pivotally mounted to frame 1 is a lower shackle assembly 50 (see FIGS. 1–4). The lower shackle assembly comprises a U-shaped support member 52 which comprises a pair of side arms 54A, 54B and a rear connecting arm 56 (as shown in FIG. 3). The side arms have aligned holes at their rear ends sized to make a close rotatable fit with a cylindrical pivot rod 58 that is mounted to and extends between lower brackets 22A, 22B. Another pivot shaft 60 is attached to and extends between side arms 54A, 54B adjacent rear connecting arm 56. The lower shackle assembly 50 also includes a U-shaped shackle yoke 62 that is rotatably mounted on pivot shaft 60 and comprises a pair of side struts 64A, 64B and a connecting strut 66 (FIG. 3). Struts 64A, 64B extend between side arms 54A, 54B respectively. A torsion spring 70 (FIGS. 3, 4 and 9) is coiled about pivot shaft 60, with a center section 72 of the spring extending outwardly of shaft 60 so as to overlap and engage connecting arm 56 of the U-shaped support member. The opposite ends 74A, 74B of spring 70 overlap the connecting strut 66 of the lower shackle yoke. As a consequence, spring 70 biases the yoke of the lower shackle against pivotal movement in a clockwise direction (clockwise as viewed in FIGS. 1, 2 and 4).

The front ends of struts 64A, 64B of yoke 62 have keyed openings in the form of rectangular holes sized so as to accommodate and make a close sliding but not rotatable fit with the rectangular front clamping bar 80 of the lower shackle assembly. Also connected to and extending between the side struts 64A, 64B of shackle yoke 62 adjacent the rear ends of those side struts is a rear clamp bar which may take the form of a flat angled plate, as in prior commercially available pump jacks, but preferably comprises a shaft or rod 82 on which is rotatably mounted a cylindrical sleeve 84.

Referring now to FIGS. 1–6, a U-shaped release member 90 is positioned between two frame members 2A, 2B. U-shaped release member 90 comprises a pair of substantially straight opposing side struts 92A, 92B that are connected at their rear (proximal) ends by an end strut 94. The latter functions as a pedal for engagement by the operator's foot. Each of the struts 92A, 92B has an elongate, longitudinally extending hole 96 (FIGS. 1 and 4) for slidably accepting a pivot shaft 98 that is anchored in and extends between frame members 2A, 2B.

Figure 5:
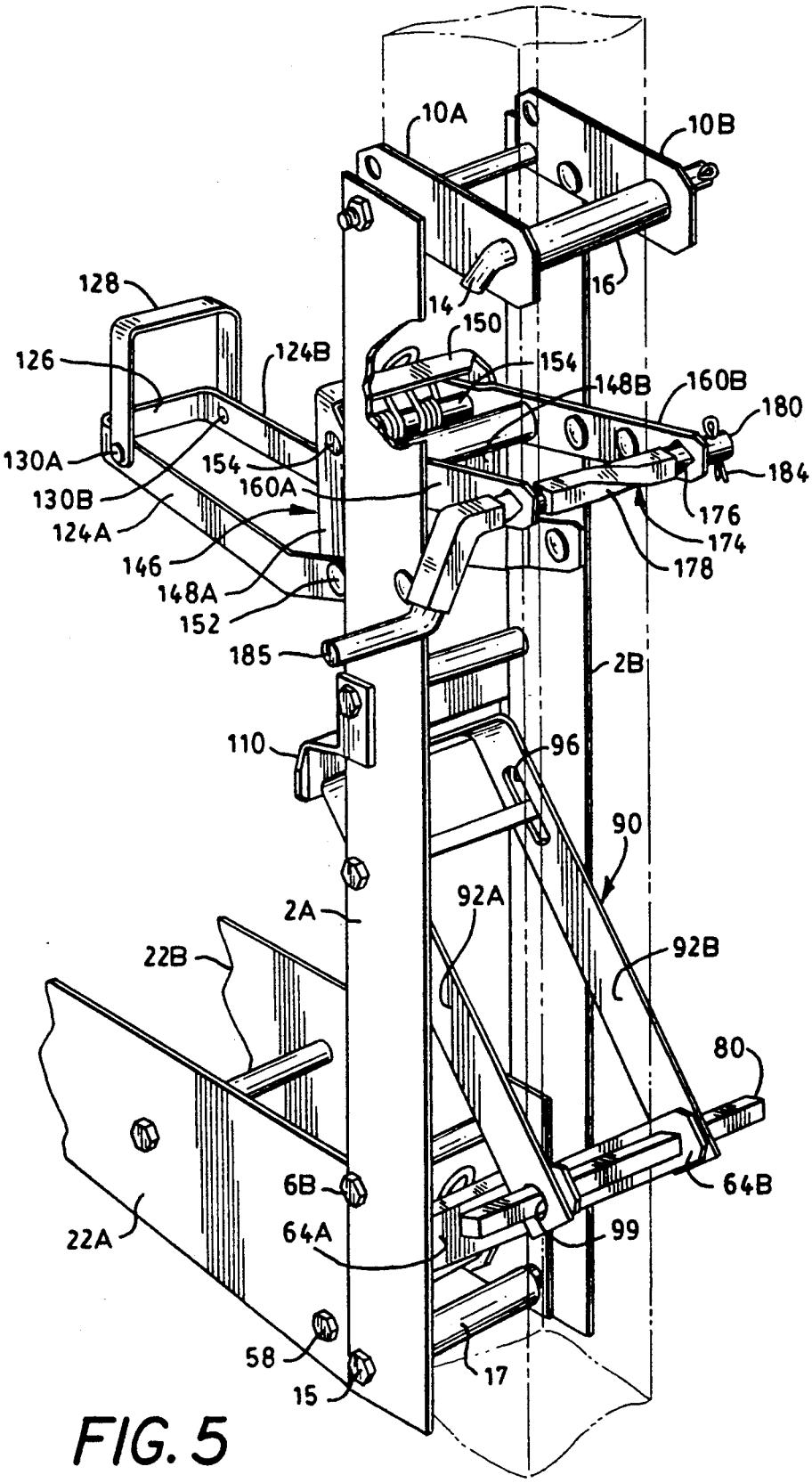
FIG. 5 is a front perspective view of the same jack.
Figure 6:
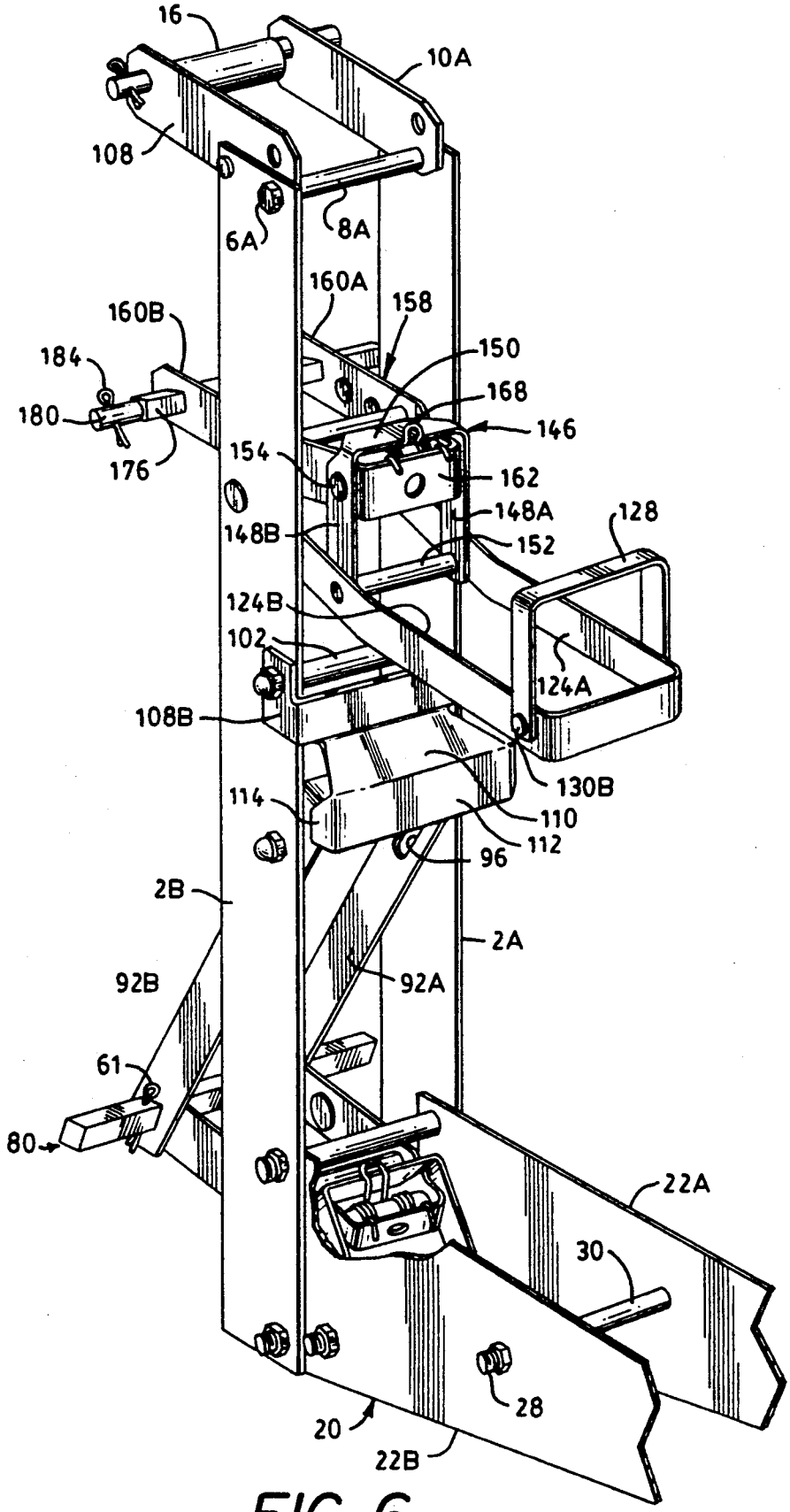
FIG. 6 is a rear perspective view of the same jack.
Figure 7:
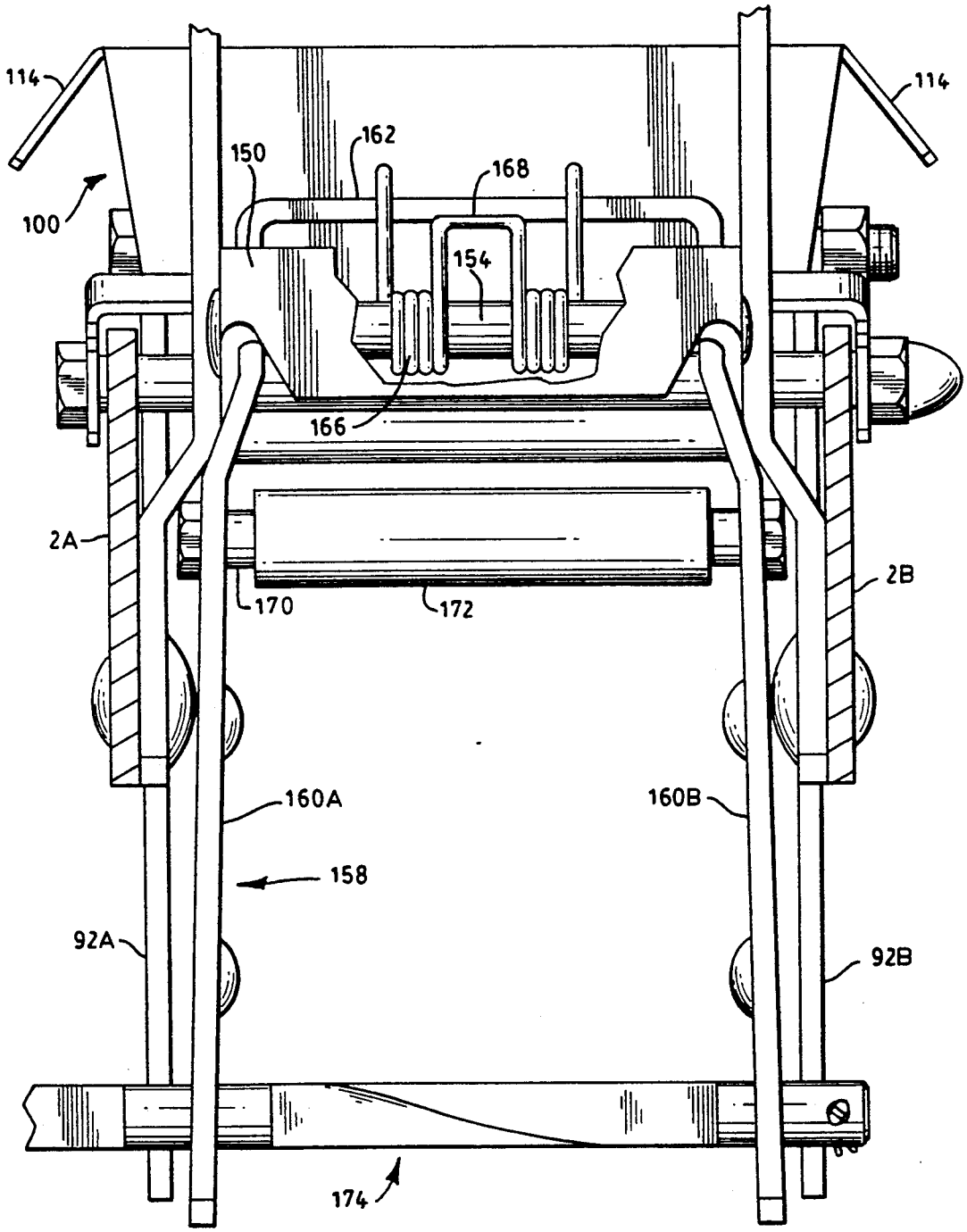
FIGS. 7, 8 and 9 are cross-sectional views taken along lines 7—7, 8—8 and 9—9 of FIG. 1.
Figure 8:
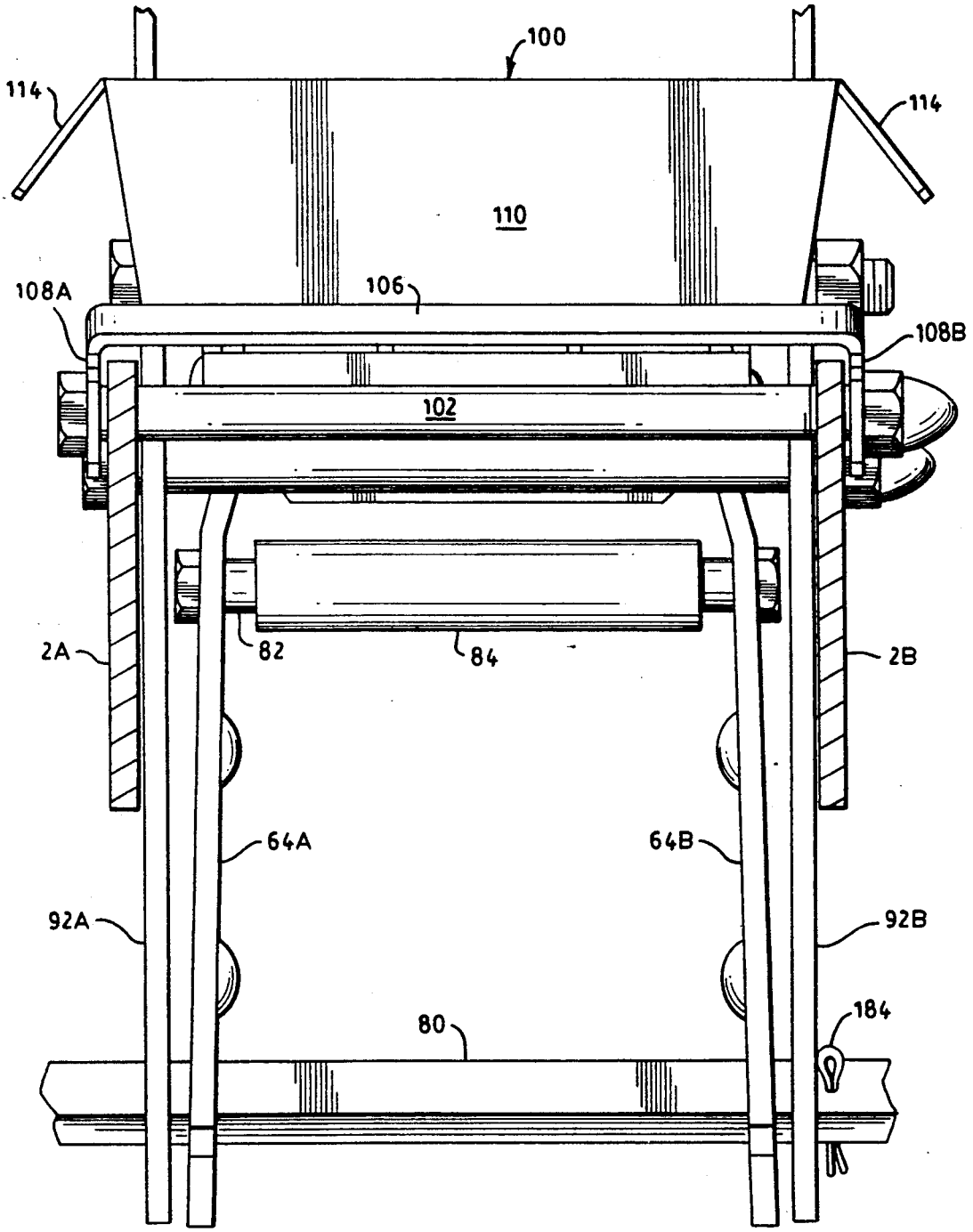

A circular opening 99 (FIG. 5) is provided at the distal (forward) end of each side strut 92A, 92B of the release member. The front clamping bar 80 extends through the keyed openings ("keyholes") in the distal ends of side struts 64A, 64B of the lower shackle yoke and also through the circular holes 99 in side struts 92A, 92B of release member 90. Front clamping bar 80 is releasably locked against removal from its connection with the release member and yoke 62 by suitable means, e.g., by cotter pin 61 (FIG. 6). Front clamping bar 80 couples the U-shaped release member 90 to the lower shackle yoke 62 whereby the latter can be operated so as to cause the lower shackle to release its grip on the supporting pole 4 when it is desired to lower the jack. The U-shaped release member's closed end extends rearwardly out from between frame members 2A, 2B above platform support 20 so that the worker can access it without reaching over the edge of the platform with his foot.

Also associated with the release mechanism is a safety cap unit 100 rotatably mounted on a pivot shaft 102 that extends between frame members 2A, 2B above pivot shaft 98. The safety cap unit extends rearwardly from the frame as shown in FIGS. 1, 2 and 4–8. In a preferred embodiment of the present invention, safety cap unit 100 is formed so as to comprise a stop portion 106, a pair of hinge portions 108A, 108B (FIGS. 1–3), and a transverse cover or cap portion 110 with a protective lip 112. The latter has angularly extending side wings 114 that overlap the side struts of the release member.

The stop portion 106 is in the form of a flat bar that extends crosswise between the outward facing surfaces of the two frame members 2A, 2B and is intended to engage the two frame members so as to hold the cap unit in a predetermined safety position, while the hinge portions 108A, 108B are angled so as to extend along side those same outward facing outer surfaces and are provided with holes to rotatably accommodate pivot shaft 102. The cover portion 110 is formed integral with and extends at an angle to stop portion 106 so as to overlie the rear connecting strut 94 of release member 90. The presence of protective lip 112 is preferred to assure that the cover portion 110 adequately covers the release lever so that the operator's foot cannot accidentally engage the release member. The wings 114 also are not critical to the invention, but their presence also is preferred so as to further assure that the operator's foot cannot accidentally engage the release member.

A substantially U-shaped pump arm 120 is pivotally connected to frame members 2A, 2B by pivot rivets 122A, 122B. Pump arm 120 comprises a pair of side struts 124A, 124B and a connecting end strut 126. Connected at the proximal end of the pump arm is a U-shaped stirrup 128. Stirrup 128 is pivotally connected to the pump arm by rivets 130A, 130B.

An upper shackle assembly 140 is connected to the pump arm. The upper shackle assembly comprises a U-shaped support member 146 (FIGS. 4 and 5) which is substantially identical to the U-shaped support member 52 of the lower shackle assembly. More specifically, support member 146 comprises a pair of side arms 148A, 148B and a connecting arm 150 (FIGS. 5 and 6). The side arms have aligned holes at their rear ends sized to make a close rotatable fit with a cylindrical pivot rod 152 that is mounted to and extends between the side struts 124A, 124B of pump arm 120. Another pivot shaft 154 is attached to and extends between side arms 148A, 148B. Pivotally mounted on pivot shaft 154 is a U-shaped shackle yoke 158 comprising a pair of side struts 160A, 160B and a connecting end strut 162. Pivot shaft 154 extends through aligned holes in side struts 160A, 160B that are sized so as to make a close rotatable fit with that pivot shaft. A torsion spring 166 (FIG. 7) is coiled about pivot shaft 154, with a center spring section 168 extending outwardly of the pivot shaft so as to overlap and engage the connecting arm 150 of U-shaped support member 146. The two opposite ends of spring 166 overlap the connecting strut 162 of shackle yoke 158. As a consequence, spring 166 biases yoke 158 against pivotal movement in a clockwise direction as viewed in FIG. 1.

Adjacent pivot shaft 154 the upper shackle is provided with a rear pole-gripping means in the form of a rod 170 on which is rotatably mounted a cylindrical sleeve 172. Rod 170 and sleeve 172 could be replaced by a flat angled plate as in prior commercially available jacks. At the forward end of the upper shackle yoke 158 is crank rod 174. The front ends of side struts 160A, 160B of yoke 158 are formed with aligned rectangular holes 176 (FIGS. 5 and 6). As seen best in FIGS. 3-5, crank rod 174 comprises a helical center portion 178 having a rectangular cross-section, an end section 180 of circular cross-section, an intermediate section 182 of circular cross-section, and a crank section 185 having a rectangular cross-section at least where it joins intermediate section 182. A cotter pin 184 inserted in a hole in end section 180 releasably prevents removal of crank rod 174 from yoke 158. The sections 180 and 182 have an axial length sufficient to permit the crank rod 174 to be moved axially relative to yoke 158 from a first rotatable position wherein circular sections 180 and 182 are aligned with struts 160A, 160B and a second locked position wherein the end of the rectangular cross-section helical center portion 178 of the crank rod 174 is disposed in registration with the rectangular hole 176 in strut 162B, whereby the crank can not be rotated. The crank rod is normally in its second locked position.

Operation of our improved jack is as follows. The jack is installed on a pole 4 so that the pole extends between (a) rod 6A and roller sleeve 16, (b) crank rod 174 and clamp sleeve 172, (c) front clamp rod 80 and sleeve 84, and (d) past and in engagement with sleeve 17. When it is desired to raises the platform, crank rod 174 is moved axially to its second locked position wherein the rectangular cross-section end of its helical center portion 178 is in registration with rectangular hole 176 in yoke side strut 160B, whereupon the crank rod 174 is locked against rotation. Thereafter, if the pump arm 120 is moved up and down by the operator's foot, the jack will move up on supporting pole 4 stepwise, one upward step for each downward step of the pump arm. When the pump arm is moved downward, crank rod 174 will grip the pole so that downward movement of the pump arm will cause the jack to move up. When this occurs, the lower shackle assembly will automatically release the pole to permit upward movement of the jack. When the pump arm is moved upwardly, the lower shackle will grip the pole to prevent the jack from falling down. Upward movement of the pump arm releases the crank rod from the pole and allows it to move up to a new pole-gripping position.

Lowering of the jack requires moving crank rod 174 axially to its first rotatable position. This is accomplished by first pulling the crank rod 174 to the left as viewed in FIG. 3 far enough so that its helical center portion 178 is removed from hole 176 in yoke arm 160B and its round sections 180 and 182 are in registration with holes 176, thereby freeing the crank rod so that it can be rotated by manual manipulation of its crank handle 185. At this point the pole 4 is gripped by the front and rear clamp means of the lower shackle. Then the operator raises the safety cap unit 100 with his foot, i.e., he uses his foot to pivot the safety cap unit clockwise (see FIG. 2). The safety cap unit 100 is raised far enough to provide enough space for the operator to be able to place his foot over and against the upper end strut 94. In this connection it is to be understood that although the pump arm 120 is shown in a horizontal position in FIG. 2, the operator can raise the pump arm to almost a vertical position if necessary when it is desired to raise the safety cap unit 100 far enough to expose the release member to the operator's foot.

Then the operator places his foot against the upper end strut 94 of the release member and presses that foot down so as to cause it to depress release member 90 far enough to cause the front clamp rod 80 of the lower shackle assembly to release or reduce its grip on the pole. Then while the release member is still being depressed, the operator grasps crank rod 174 and rotates it clockwise (as viewed in FIG. 1) to cause the jack to drop down on the pole. The releasing action of release member 90 is opposed by torsion spring 70 which tends to return the lower shackle to a pole-gripping position. Consequently, upon release of release member 90, torsion spring 70 will bias the lower shackle back into clamping relation with pole 4, whereupon the jack will again be secured to the pole by the lower shackle assembly. Thereafter, the operator may again move the crank rod to the right (as viewed in FIG. 3) far enough to again lock it against rotation.

A variety of possible modifications of the invention will be obvious to persons skilled in the art. Thus, for example, welded cross-members may be used in place of the tie bolts/spacer sleeves to secure the side frame members 2A, 2B and/or the brackets 22A, 22B in parallel fixed relation to one another as described and illustrated. Also, the rear clamping bars of the upper and lower shackles may be replaced by flat plates inclined so as to extend parallel to the supporting poles 4. It is to be appreciated also that the release member need be moved only a short distance, e.g., ⅛ inch or less, in order to move the front clamping bar far enough to allow the jack to be moved downward by rotation of the crank arm rod 174. Accordingly, the length of the elongate holes 96 may be set so as to have a stroke-limiting effect on lengthwise movement of the release member. Alternatively, the invention may include a means (not shown) that is designed to assure that the operator's foot may move the release member only a fraction of an inch, just enough to allow the jack to be moved downward in a controlled fashion under the cranking action of crank rod 174. Also the invention is not limited to a particular form of shackle or pump arm, so that different forms of such means may be employed. Still other modifications will be obvious to persons skilled in the art from the foregoing description and FIGS. 1-9.

Therefore, it is intended that all matter contained in the above description or shown in the accompanying drawings shall be interpreted in an illustrative and not in a limiting sense. The present invention is indicated by the broad general meaning of the terms in which the appended claims are expressed.

What is claimed is:

1. A pump jack for traveling up and down a pole comprising:

a frame having a pair of laterally spaced frame members coupled together for straddling said pole;

first and second mutually-spaced shackle assemblies pivotally supported by said frame;

a platform support secured to and extending from said frame;

a pump arm pivotally coupled to said frame and one of said shackle assemblies for causing said first and second shackle assemblies to alternately grip and release the pole with the non-gripping one of said shackle assemblies being stepped upwardly along the pole as said pump arm is pivoted bidirectionally relative to said frame;

said one shackle assembly having a first shackle member and a helical rod rotatably mounted to the front end of said first shackle member, said rod having a crank handle for rotating said helical rod so as to cause the pump jack to ride down the pole when the other shackle assembly is in releasing relation with said pole;

said other shackle assembly comprising a second shackle member having a pair of side arms extending between said laterally spaced frame members, each of said side arms having a front portion and a rear portion, a first pole-clamping member attached to and extending between said front portions of said side arms, a second pole-clamping member attached to and extending between said rear portions of said side arms in parallel spaced relation to said first pole-clamping member, a U-shaped supporting member disposed between and pivotally connected to said frame, said U-shaped supporting member comprising a pair of side struts and a connecting strut, said side struts having front ends pivotally connected to the rear ends of said side arms so as to permit said second shackle member to pivot relative to said U-shaped supporting member, and a torsion spring coupled to said second shackle member and said U-shaped member for biasing said second shackle member against pivotal movement in a first direction relative to said supporting member;

said jack having a release assembly that is characterized by:

a release member positioned between said laterally spaced frame members;

means coupling said release member to said second shackle member; and pivot means for mounting said release member to said frame members whereby said release member is capable of movement relative to said pivot means so that when said release member is engaged by the foot of an operator, said release member will cause said first pole-clamping member of said other shackle assembly to release said pole.

2. A pump jack according to claim 1 wherein said release member comprises a pair of opposed side struts and an end strut connecting corresponding ends of said side struts, with said side struts of said release member being arranged so that said end strut extends outwardly of said frame members and above said platform support in position for it to be engaged by an operator, said side struts of said release member also having opposing longitudinally elongate holes adjacent their rear ends; and further including a first pivot shaft extending between said frame members and through said elongate holes, said first pole-clamping member of said other shackle assembly being attached to and extending between the front ends of said side struts of said release member.

3. A pump jack according to claim 1 further including safety means for preventing accidental operation of said release member.

4. A pump jack according to claim 3 wherein said safety means comprises a cap member pivotally mounted to said frame so as to be movable on its pivot axis from a first position wherein it covers said release member to a second position wherein it exposes said release member for engagement by the operator.

5. A pump jack according to claim 4 wherein said cap member comprises a stop portion in position to engage at least a portion of said frame and thereby position said cap member so as to prevent engagement of said release member by the foot of an operator.

6. A pump jack according to claim 1 wherein said side arms of said second shackle member include polygonal holes at their front ends, and said first pole-clamping member is an elongate bar having a clamping bar having a portion with a cross-section that mates with said polygonal holes so as to prevent rotation of said bar in said polygonal holes.

7. A pump jack according to claim 1 wherein said release member is a one-piece U-shaped member.

8. A pump jack according to claim 7 wherein said U-shaped member is formed of flat bar stock having a rectangular cross-section.

9. A pump jack for traveling up and down a pole comprising a frame having a pair of laterally spaced frame members coupled together for straddling a pole;

upper and lower pole-engaging shackle assemblies pivotally supported by said frame;

a platform support extending from said frame;

a pump arm pivotally coupled to said frame and said upper shackle assembly for pivoting said upper shackle assembly bidirectionally relative to said frame, whereby to cause said upper and lower shackle assemblies to alternately grip the pole with the non-gripping one of said shackle assemblies being stepped upwardly along the pole as a consequence of movement of said pump arm;

said upper shackle assembly comprising a first U-shaped yoke having first and second arms with mutually spaced front ends, and a rotatable spiral rod carried by said front ends of said first and second arms, said spiral rod having a handle for rotating said spiral rod so as to cause the pump jack to ride down the pole;

said lower shackle assembly comprising a second U-shaped yoke having a pair of mutually-spaced side arms extending between said laterally spaced frame members, each of said side arms having a front portion and a rear portion, a front clamping bar attached to and extending between said front portions of said side arms of said second yoke, a support member pivotally connected to said frame and also to said rear portions of said side arms of said second yoke, and a torsion spring coupled to said second yoke and said support member for biasing said lower shackle assembly into gripping engagement with said pole;

said improved jack being characterized by:

a release assembly comprising a release member having a pair of opposed side struts, and an end strut connecting corresponding ends of said side struts, said side struts being arranged so that said end strut projects outwardly of said frame members and above said platform support, the side struts of said release member each having an elongate hole at a rear end thereof;

a pivot shaft attached to said frame members and extending through said elongate holes, said side struts of said release member being slidable and rotatable relative to said pivot shaft;

said second yoke of said lower shackle assembly being attached to and extending between the forward ends of said side struts of said release member so that movement of said release member will cause said front clamping bar of said second shackle assembly to shift out of gripping engagement with said pole.

10. A pump jack according to claim 9 wherein said release member is arranged so that when depressed by an operator it will cause said lower shackle assembly to shift in a direction to force said front clamping bar of said lower shackle assembly out of gripping engagement with said pole, so as to permit said jack to be lowered on said pole.

11. A jack according to claim 10 wherein said release member is a U-shaped bar and said end strut extends crosswise of said frame members.

12. A pump jack according to claim 9 further including safety means for preventing accidental operation of said release assembly.

13. A pump jack according to claim 12 wherein said safety means comprises a safety cap member pivotally mounted to said frame, said safety cap member comprising a first portion extending outwardly of said frame and overlying said release member so as to prevent accidental engagement of said release member by an operator.

14. A jack according to claim 9 further including safety means in the form of a pivotally-mounted safety cap member that includes a stop portion in position to engage said frame and thereby limit pivotal movement of said safety cap member in a first direction.

15. A jack according to claim 14 wherein said cap member extends crosswise of said frame members.

16. A jack according to claim 15 wherein said release member is arranged so as to apply a symmetrical releasing force to said front clamping bar of said lower shackle.

17. A jack according to claim 14 wherein said cap member is movable between a first position wherein it acts as a barrier to engagement of said release member by an operator's foot to a second position wherein it exposes said release member for engagement and movement by an operator's foot.

* * * * *